US011130169B2

(12) United States Patent
Zumbusch et al.

(10) Patent No.: US 11,130,169 B2
(45) **Date of Patent: *Sep. 28, 2021**

(54) USE OF A FEEDER INSERT AND METHOD FOR MANUFACTURING A CASTING MOLD HAVING A VERTICAL MOLD SEPARATION

(71) Applicants: CHEMEX FOUNDRY SOLUTIONS GMBH, Delligsen (DE); HUETTENES-ALBERTUS Chemische Werke GmbH, Düsseldorf (DE)

(72) Inventors: Lars Zumbusch, Langenfeld (DE); Claus Joachim, Luebeck (DE); Guido Brieger, Bochum (DE); Michael Biemel, Wuerzburg (DE)

(73) Assignees: CHEMEX FOUNDRY SOLUTIONS GMBH, Delligsen (DE); HUETTENES-ALBERTUS CHEMISCHE WERKE GMBH, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/783,805

(22) Filed: Feb. 6, 2020

(65) Prior Publication Data

US 2020/0171562 A1 Jun. 4, 2020

Related U.S. Application Data

(63) Continuation of application No. 15/044,612, filed on Feb. 16, 2016, now Pat. No. 10,589,346.

(30) Foreign Application Priority Data

Feb. 13, 2015 (DE) ..... 102015202709.0

(51) Int. Cl.
*B22C 9/08* (2006.01)
*B22C 9/02* (2006.01)
*B22C 11/10* (2006.01)

(52) U.S. Cl.
CPC ..... *B22C 9/088* (2013.01); *B22C 9/02* (2013.01); *B22C 11/10* (2013.01)

(58) Field of Classification Search
CPC ..... B22C 9/088; B22C 9/02; B22D 11/10
See application file for complete search history.

(56) References Cited

U.S. PATENT DOCUMENTS 10,589,346 B2 * 3/2020 Zumbusch et al. ..... B22C 9/02
2008/0135205 A1 6/2008 Jezwinski
(Continued)

FOREIGN PATENT DOCUMENTS

CN 102641994 8/2012
DE 2803247 7/1979
(Continued)

OTHER PUBLICATIONS

"Blueprint of KAPPE KX 40-70W MQx1," GTP Schäfer Gießtechnische Produkte, D-41515 Grevenbroich, Benzstraße 15, Alleged date of Oct. 11, 2013.
(Continued)

*Primary Examiner* — Kevin P Kerns
*Assistant Examiner* — Steven S Ha
(74) *Attorney, Agent, or Firm* — Duane Morris LLP; Gregory M. Lefkowitz

(57) ABSTRACT

A use of a feeder insert, having a volumetric center of gravity which is offset in relation to the opening axis of the passage opening of said feeder insert, in the manufacture of a casting mold having a vertical mold separation and a feeder insert which for dense feeding of the mold cavity during the casting procedure is attached to the casting mold,
(Continued)

is described, wherein the feeder insert is positioned in a prefabricated mold part of the casting mold such that the opening axis of said feeder insert runs below the volumetric center of gravity of the latter.

15 Claims, 5 Drawing Sheets

(56) References Cited

U.S. PATENT DOCUMENTS

| | | | |
|---|---|---|---|
| 2011/0290981 | A1 | 12/2011 | Hansen et al. |
| 2012/0211192 | A1 | 8/2012 | Sallstrom et al. |
| 2014/0110075 | A1 | 4/2014 | Paalanen et al. |
| 2016/0101461 | A1 | 4/2016 | Beckmann et al. |

FOREIGN PATENT DOCUMENTS

| | | | | |
|---|---|---|---|---|
| DE | 8702296.6 | | 4/1987 | |
| DE | 4219632 | | 1/1994 | |
| DE | 102013209775 | | 10/2014 | |
| WO | 00/67934 | | 11/2000 | |
| WO | 2012172154 | | 12/2012 | |
| WO | WO-2012172154 | A1 * | 12/2012 | ..... B22C 9/084 |
| WO | 20140191423 | | 12/2014 | |
| WO | 2015008866 | | 1/2015 | |

OTHER PUBLICATIONS

Alleged GTP Schäfer Invoice No. 47618, dated Jan. 16, 2014, Selling: Sleeve KX 40-70W MQx1.

Alleged GTP Schäfer Invoice No. 47733, dated Jan. 27, 2014, Selling: Sleeve KX 40-70W MQx1.

Alleged GTP Schäfer Invoice No. 55539, dated Jan. 27, 2014, Selling: Sleeve KX 40-70W MQx1.

Alleged GTP Schäfer Invoice No. 55362, dated Jan. 14, 2014, Selling: Sleeve KX 40-70W MQx1, Filtersleeve, THERMO-Risers and POINT-Risers.

Alleged GTP Schäfer Invoice No. 50289, dated Oct. 28, 2014, Selling: Sleeve KX 40-70W MQx1.

Alleged GTP Schäfer Invoice No. 58733, dated Oct. 28, 2014, Selling: Sleeve KX 40-70W MQx1.

Alleged email correspondence, with attachment, between Joy-Mark, GTP-Schaefer, Metal-Technologies and Carpenter Brothers Inc., Subject Lines: "Small sleeves to set as cores" and "Joymark/Fiber: Small sleeves to set as cores / our officer," various dates between Jul. 13, 2013 and Aug. 6, 2013.

Alleged email correspondence, with attachments, between Joy-Mark, Neenah Enterprises, Carpenter Brothers Inc. and GTP-Schaefer, Subject Line: "GTP Joymark (Requested Product Information)," dated Oct. 13, 2013.

* cited by examiner

USE OF A FEEDER INSERT AND METHOD FOR MANUFACTURING A CASTING MOLD HAVING A VERTICAL MOLD SEPARATION

CROSS-REFERENCE TO RELATED APPLICATIONS

This application is a continuation of U.S. application Ser. No. 15/044,612, filed Feb. 16, 2016, which claims priority to German Patent Application No. 102015202709.0, filed Feb. 13, 2015, the entire contents of which are incorporated herein by reference.

BACKGROUND OF THE INVENTION

The present invention relates to the use of a feeder insert, having a volumetric center of gravity which is offset in relation to the opening axis of the passage opening of said feeder insert, in the manufacture of a casting mold having a vertical mold separation and a feeder insert which for dense feeding of the mold cavity during the casting procedure is attached to the casting mold. The invention furthermore relates to a method for manufacturing a casting mold having a vertical mold separation and a feeder insert which for dense feeding of the mold cavity during the casting procedure is attached to the casting mold. The invention also relates to corresponding casting molds and feeder inserts.

Feeder systems with one or multiple parts are employed in large numbers and varieties in casting metals in casting molds. The feeder systems, also referred to as feeders, used are largely surrounded by a molding material, such as molding sand, which is used to manufacture the casting mold, and on account thereof held in a position in relation to the mold cavity in the casting mold. Known feeders have a feeder cavity having a passage opening for the liquid metal, on account of which there is a connection between the mold cavity and the feeder cavity. On account thereof, a partial amount of the metal which during the casting procedure is filled into the mold cavity of the casting mold enters the feeder and thus the feeder cavity. During the solidifying procedure which is associated with contraction of the cast metal, the liquid metal which is located in the feeder system should be able to flow back into the casting mold, so as to there equalize or compensate for the shrinkage of the casting down to the solidus temperature, respectively.

For this purpose, the metal which has made its way into the feeder insert is kept in the liquid state for as long as until the metal which is present in the interior of the casting mold has solidified or has partially solidified to form the casting. Therefore, at least part of the feeder insert is usually composed of an insulating and/or exothermal material. Exothermal materials have the property of being ignited on account of the high temperatures which prevail when liquid metal enters into the feeder cavity of the feeder insert. From this point in time on, an exothermal reaction is automatically performed within the material of the feeder insert, so that thermal energy is released over a certain period of time to the metal which is located in the feeder cavity. The metal in the feeder system and in the transition region to the mold cavity of the casting mold is thus kept in the liquid state.

Requirements pertaining to productivity have been significantly increased also in the foundry sector, leading to the search for possibilities for automating the manufacture of molds and for the manufacture of casting molds for castings in large volumes to be designed in a more efficient manner. For this purpose, automated vertical greensand molding plants (for example Disamatic molding machines by DISA Industries A/S) have been developed. These molding machines have two pattern halves, of which a first pattern half is mounted on a press piston which is adjustable exclusively in a linear manner and the second pattern half is mounted on a pivotable mold plate, which is also referred to as a pivoting plate. The pivotable mold plate may be moved to and fro between a horizontal alignment in which the second pattern half is equipped with a feeder system, and a vertical alignment. In the vertical alignment thereof, which corresponds to the operating position of the pivoting plate, the pivoting plate is displaceable together with the first pattern half, also referred to as the pressing plate, in a manner parallel with the press piston. The pressing plate and the pivoting plate at least laterally delimit a mold chamber into which the molding material for configuring at least one mold half of a casting mold is filled. The filled molding material is subsequently compressed by relative movement between the pressing plate and the pivoting plate, and a mold half or a mold part, respectively, is thus produced. A feeder system which is disposed on the pattern half on the pivoting plate and which during manufacturing of the mold part is thus disposed in the mold chamber, is received within the produced mold part. Such feeder systems by way of longitudinal feeder axis thereof are aligned so as to be approximately vertical to the pivotable mold plate, so that the passage opening of the feeder insert during casting runs in an approximately horizontal manner. In order for the feeder volume to be minimized, known feeder inserts moreover have a volumetric center of gravity which is offset in relation to the passage opening and which during the casting procedure in particular is disposed above the opening axis of the passage opening.

Feeder systems for use in the manufacture of a split-type casting mold are known from publications EP 2 489 450 A1 (DE 20 2011 103 718 U1) and DE 10 2013 209 775 B3. The disclosed assemblies comprise a mold plate and/or a mold pattern and furthermore at least one feeder system having a feeder element and a feeder insert. The feeder element and the feeder insert delimit the feeder cavity for receiving the liquid metal. The feeder element has a first end by way of which the former stands or sits in a usually directly bearing manner on the mold plate and/or on the mold pattern. The feeder element has a passage opening by way of which the connection between the mold cavity of the casting mold and the feeder cavity of the feeder system is guaranteed. The passage opening here is delimited by a side wall of the feeder element.

In order for the forces which during compressing of the molding material which is used for manufacturing the mold part of the casting mold act on the known feeder systems to be able to be absorbed, the side wall around the passage opening according to EP 2 489 450 A1 is configured so as to be deformable. The side wall is deformable in such a manner that a reduction of the spacing between the first end of the feeder element and the second end of the feeder element to which the feeder insert of the feeder system is fastened by way of a fitting element on the feeder element results. This results in an overall reduction of the total height of the feeder system.

Alternatively, it is proposed according to DE 10 2013 209 775 B3 that the feeder element and the feeder insert are configured so as to be mutually displaceable. In this way, the compression force which is created during compression of the molding material is compensated for also in this known feeder system by pushing together the feeder system in a manner vertical to the opening axis of the passage opening.

One disadvantage which may arise in some cases when using the known feeder systems is caused by the passage opening which is offset in relation to the volumetric center of gravity of the feeder system and by the side wall which delimits the passage opening and which sits on the first end of the feeder element on the mold plate. The side wall, which serves as a placement face of the feeder system on the mold plate or on the mold pattern, is likewise disposed so as to be offset in relation to the volumetric center of gravity of the feeder cavity, so that a force which acts in the direction of the opening axis of the passage opening during compressing of the molding material produces a tilting moment in the region of the placement face. Especially in the case of high compression pressures in the mold chamber, the feeder system may slightly tilt, so that the placement face at the first end of the feeder element bears in a non-uniform manner on the mold plate or on the mold pattern. In this way, reliable sealing in the transition region between the feeder and the mold cavity may in some instances no longer be guaranteed, and disadvantages may arise during the casting procedure, for example entry of molding material into the mold cavity or configuration of an untidy breaker edge which is to be configured on the transition between the casting and the feeder.

BRIEF SUMMARY OF THE INVENTION

Proceeding from the issues which have been set forth above, the invention is based on the object of stating a use of a feeder insert in the manufacture of a casting mold and a method for manufacturing a casting mold having a vertical mold separation, by way of which the manufacture of a vertical split-type casting mold is enabled in a simplified manner, while avoiding individual or all of the disadvantages described above. The invention achieves the object on which it is based by using a feeder insert having the features of claim 1. In particular, the feeder insert is positioned in a prefabricated mold part of the casting mold such that the opening axis of said feeder insert runs below the volumetric center of gravity of the latter.

The invention thus relates to the use of a feeder insert which is suitable for manufacturing a casting mold having a vertical mold separation. Such casting molds may be manufactured for example by vertical molding plants, such as by Disamatic molding machines by DISA Industries A/S, for example. According to the invention, it is provided in the use of a feeder insert having a volumetric center of gravity which is offset in relation to the opening axis of the passage opening of said feeder insert that the feeder insert is positioned in a prefabricated mold part of the casting mold such that the opening axis of said feeder insert preferably has an approximately horizontal alignment and is or runs below the volumetric center of gravity of the latter, respectively. The invention is based on the concept that follow-on feeding of liquid metal into the mold cavity may be guaranteed through a feeder insert which is disposed laterally to a mold cavity to be produced. Moreover, manufacturing of vertical split-type casting molds is advantageously simplified since the employment of a feeder system having a compressible portion or two elements which are held so as to be movable in relation to one another may be dispensed with. The casting mold to be produced may thus be manufactured without considering constructive characteristics of a feeder system which is located in the mold chamber during the manufacture of the mold part. In the case of the use according to the invention of the feeder insert, the feeder insert which is preferably not (or only slightly) compressible (longitudinally compressible) is positioned in the mold part after prefabrication of the latter. In order for the feeder insert to be able to be positioned in the prefabricated mold part, the mold part during manufacture thereof is equipped with holding means for the feeder insert, or the holding means are configured on the mold part, respectively. Equipping the mold part with holding means, or configuring the holding means on the mold part, respectively, is preferably performed during prefabrication of the mold part in the molding plant.

According to one preferred embodiment of the invention, the feeder insert for positioning in the prefabricated mold part of the casting mold is inserted into a recess in the prefabricated mold part of the casting mold. Providing a recess is an advantageously simple possibility in order to be able to position the feeder insert within the mold part of the casting mold. The recess produced in the mold part as a holding means in the mold part here receives at least one portion of the feeder insert which preferably extends parallel with the opening axis of the passage opening. In one alternative embodiment, the feeder insert is received by way of wall regions in the recess in the mold part, which configure a region in the circumferential direction about the opening axis of the passage opening of the feeder insert. When the feeder insert is positioned in the recess, attention has to be paid that the opening axis of the passage opening runs below the volumetric center of gravity of the feeder insert. In order for erroneous positioning of the feeder insert in the mold part to be avoided, the recess and the feeder insert are preferably configured in such a manner that the two latter define a preferred orientation for inserting the feeder insert into the recess.

Preferably, the casting mold having a vertical mold separation and a feeder insert which for dense feeding of the mold cavity during the casting procedure is attached to the casting mold is manufactured in a molding plant having a (so-called endless) mold parts string. The casting mold which is assembled from at least one first and one second mold part is produced by placing the two mold parts beside one another, while configuring a mold parts string. One special embodiment of the invention provides that one or both mold parts are produced in separate molding machines. In this special case, the prefabricated mold parts for manufacturing the casting mold are supplied to said molding plant in which the separately prefabricated mold parts are joined together. Inserting a feeder insert into a respective mold part is usually performed immediately after manufacturing a separately prefabricated mold part, or during manufacturing, in particular when the prefabricated mold parts are assembled to form the casting mold.

According to one other design embodiment of the use according to the invention, the feeder insert is positioned in a prefabricated mold part of the casting mold, wherein the mold part is prefabricated in a or the molding plant, respectively, having an endless mold parts string. Prefabrication of the mold parts and joining of the prefabricated mold parts and manufacturing of the casting mold associated therewith is preferably performed in a single molding plant, wherein prefabricating per se and thus manufacturing of the individual mold parts is carried out using a molding material. After manufacturing of the mold parts, on account of which prefabricating the individual mold parts is terminated, the feeder insert is positioned in a mold part which is in each case assigned, preferably inserted into a recess in the mold part. After insertion of the feeder insert, the mold part together with a mold part which has been previously manufactured by the molding plant, is assembled to form a casting mold. In order for the casting mold to be manufactured, the prefabricated mold parts are preferably lined up behind one another to form an endless mold parts string.

Preferably, the mold part is prefabricated in a mold chamber in that molding material is injected into the mold chamber and the injected molding material is preferably subsequently compressed. Preferably, a predefined amount, or a preadjustable amount or mass of molding material is filled, in particular injected, into the mold chamber. By injecting the molding material, a shortened filling procedure of the mold chamber is achieved, advantageously reducing the time for manufacturing a mold part. According to one design embodiment of the invention, the molding material is preferably injected into the mold chamber at high pressure. Preferably, the mold chamber is completely filled by the molding material which is used for configuring the mold part. It is optionally provided that the molding material is even further compressed once the molding material has been injected into the mold chamber. This is preferably performed by impinging the molding material with a pressure force.

Preferably, the mold part is prefabricated in a mold chamber which is partially delimited by a positive pattern of at least one portion of the feeder insert. The positive pattern delimiting the mold chamber is an image of at least one portion of the feeder insert to be positioned in the mold part. Preferably, by means of the positive pattern a recess in the mold part into which the feeder insert is inserted at least by way of a portion which extends in the direction of the opening axis, or by way of a region running in the circumferential direction about the opening axis, is produced. Preferably, the feeder insert is positioned in the mold part such that or is held in such a manner in the mold part, respectively, that the opening axis of the passage opening of said feeder insert runs below the volumetric center of gravity of the feeder cavity. The opening axis of the passage opening of the feeder insert during use of the latter moreover has a preferably horizontal alignment.

The mold chamber is preferably formed in molding plant having a pivoting plate and a pressing plate, and the positive pattern of said portion of the feeder insert is disposed on the pivoting plate or on the pressing plate. By disposing the positive pattern on the pressing plate or on the pivoting plate it is advantageously caused that the recess which is provided for receiving the feeder insert during manufacturing of the mold part is produced in a preferably vertical separation face of the mold part to be manufactured. The vertical separation faces of the mold part in which the contour regions of a part of the mold cavity of the mold part to be manufactured are produced are preferably produced by means of the pivoting plate and the pressing plate. The at least one portion of the positive pattern imaging the feeder insert preferably protrudes in an approximately perpendicular manner from the pattern half for the mold part which is disposed on the pressing plate or on the pivoting plate. This advantageous design embodiment of the invention is combinable with further preferred aspects of the present invention. In terms of preferable combinations, the narrative made in the corresponding text passages applies in each case in a corresponding manner.

The feeder insert is preferably inserted into the recess in a form-fitting and/or force-fitting manner. A force-fit or a form-fit is preferably caused between the wall faces of the feeder insert and the wall faces which delimit the recess. In this way, the feeder insert is firmly and at the same time reliably received in the recess provided therefor during the casting procedure. On account thereof, inadvertent movement of the feeder insert in the recess and thus in relation to the mold part is advantageously avoided. Preferably, the feeder insert is fixed in the insertion direction, that is to say in the direction of the opening axis, by means of a force-fitting connection, in particular by friction force between the mutually bearing wall faces of the feeder insert and of the recess. Moreover, the feeder insert and the recess provided therefor in terms of shape are adapted to one another in such a manner that the feeder insert is inserted into the recess in the mold part in a preferred orientation. Preferably, the feeder insert may be positioned in only one single alignment in relation to the recess in the mold part. The recess and the feeder insert communicating therewith configure a form-fit so that the feeder insert in the recess cannot be displaced transversely to the insertion direction or rotated about an axis running in the insertion direction, respectively. Insertion direction here is understood to be that direction in which the feeder insert is inserted or pushed into the recess, respectively. The opening axis of the passage opening and the insertion direction of the feeder insert in the mold part preferably run parallel with one another.

The feeder insert is preferably inserted manually or in an automated manner by means of an insertion installation into the recess. Positioning of the feeder insert in the mold part, preferably inserting the feeder insert into the recess in the mold part, is thus selectively performed manually, that is to say by hand, or in a mechanized manner with the aid of an insertion installation. Positioning or inserting, respectively, is performed after prefabricating the mold part in the mold chamber of the molding plant, requiring that manufacturing of the mold part per se has been terminated. The feeder insert is thus not subjected to any compression procedure such as is usual in the manufacture of a mold part. Thus, the feeder insert which is inserted into the mold part need not be compressible (in particular longitudinally compressible) per se. Insertion of the feeder insert into the mold part is preferably performed once the prefabricated mold part has been pushed out of the mold chamber. The feeder insert is either inserted into the mold part prior to the mold part by way of the mutually facing separation faces being brought into contact with a previously manufactured mold part, or after the manufactured mold part by way of the separation faces is assembled with a previously manufactured mold part to form a casting mold. The point in time which is to be selected for the afore-described insertion of the feeder insert is also determined on account of into which region of the mold cavity of the casting mold the feeder insert is to be inserted. Inserting the feeder insert by way of an insertion installation (with automated operation) in comparison with manual insertion has the advantage that the insertion procedure is accelerated and the cycle times for joining the mold parts which are preferably lined up behind one another to form an endless string of casting molds are thus reduced.

In a use according to the invention of the feeder insert it is preferably provided that the feeder insert has a first end having a passage opening, a second end, and one or a plurality of side walls which extend from the first to the second end and which delimit a feeder cavity for receiving liquid metal, and has a wall portion which is disposed at the first end and which forms a lateral wall region of the mold cavity of the casting mold. With the aid of that wall region that is disposed at the first end of the feeder insert, the feeder cavity is preferably delimited in the direction of the preferably adjacent mold cavity of the casting mold. The side wall which extends from the first to the second end delimits the feeder cavity in relation to at least one region of the mold part produced. The passage opening in the wall portion at the first end configures a constriction and preferably a breaker core on the feeder insert which enables simplified separation of the casting and the feeder after casting. On account of the predefined positioning of the feeder insert in the mold part, by means of the wall portion on the first end of the feeder insert at least one lateral wall region of the mold cavity of the casting mold is configured. By way of the wall portion at the first end, areas of the separations face of a first mold part of a casting mold may also be configured.

Preferably, the wall portion at the first end of the feeder insert has an internal wall face which faces the feeder cavity and which delimits a cavity portion which is tapered in the direction of the passage opening. In this way, a sharp breaker edge is preferably produced in the transition region between the mold cavity of the casting mold and the feeder cavity of the feeder; on account thereof, separation of the feeder insert from the later casting is advantageously simplified. On account of the passage opening which is disposed on the wall portion of the first end of the feeder insert so as to be offset in relation to the volumetric center of gravity, the cavity portion is regularly tapered in a non-uniform manner about the passage opening; the internal wall face of the wall portion here has areas having various inclination angles in relation to the opening axis of the passage opening. Preferably, the wall face that delimits the tapered cavity portion has a shape which is similar to that of an oblique truncated cone.

Preferably, the wall portion which is disposed at the first end of the feeder insert has a planar wall face portion which faces the mold cavity of the casting mold. By way of the design embodiment of a planar wall face portion at the first end of the feeder insert a separation of simple construction is achieved between the mold cavity and the wall portion of the feeder insert which configures a wall face of the mold cavity. Depending on the shape of the casting to be manufactured, that wall face of the wall portion at the first end of the feeder insert that faces the mold cavity in an alternative design embodiment has a stepped shape or in portions an inclined profile in relation to the opening axis of the passage opening.

According to one other refinement of the invention it is provided that one or a plurality of side wall(s) project(s) in a substantially perpendicular manner from the wall portion, or that the at least one side wall is aligned so as to be approximately parallel with the opening axis of the passage opening. In this way, the feeder insert has a feeder cavity which preferably extends in the direction of the opening axis and which has an almost identical cross section from the first to the second end of the feeder insert. The side walls on the external side and on the internal side thereof are preferably configured so as to be planar, that is to say without steps in the wall profile, on account of which insertion of the feeder insert by way of the external wall face of the side wall thereof into a recess in the mold part and discharge of the liquid metal in the direction of the passage opening in the feeder cavity is facilitated.

Preferably, additionally one or a plurality of openings for ventilating the feeder cavity and/or for holding means of an insertion installation engaging therein is/are disposed in the wall portion which has the passage opening. By way of the ventilation opening it is advantageously ensured during use of the feeder insert that no gas cushion can be formed above the liquid metal in the feeder cavity, in particular during the filling procedure. Gases which are potentially created or released during the casting procedure may escape in a simple manner via the ventilation opening. Preferably, the ventilation opening in the case of a horizontal arrangement of the opening axis of the passage opening is disposed above the passage opening on the wall portion at the first end of the feeder insert. Preferably, the ventilation openings may at the same time be used for engaging holding means of an insertion installation, on account of which a preferred orientation results during aligning or equipping an insertion installation which positions the feeder insert in the mold part with the feeder insert, respectively. The ventilation openings preferably have a diameter which is dissimilar to the diameter of the passage opening, on account of which erroneous equipping of the feeder insert on the insertion installation is fundamentally avoided. Preferably, the holding means of the insertion installation communicate in a form-fitting manner with the ventilation openings in the wall portion of the feeder insert, on account of which the feeder insert is securely fixed to the insertion installation during insertion into or positioning in the mold part, respectively. This advantageous design embodiment of the invention is in each case combinable with the independent aspects of the present invention. In terms of preferable combinations, the narrative made in the corresponding text passages applies in each case in a corresponding manner.

According to one preferred design embodiment of the invention, the feeder insert in relation to the longitudinal extent thereof in the direction of the opening axis is non-destructively longitudinally compressible by not more than 5%, preferably not more than 2%. On account thereof that the feeder insert is positioned in the mold part after the molding material for the mold part has been compressed in the mold chamber, the feeder insert, or parts thereof, respectively, need not be configured so as to be mutually deformable or displaceable. Therefore, the design in terms of construction of the feeder insert used in comparison with the known feeder systems is significantly simplified. Depending on the materials used in the design embodiment of the feeder insert, the latter has a predetermined deformation capability which however in the direction of the opening axis is preferably not more than 5%, preferably not more than 2% of the original nominal length of the feeder insert.

Preferably, the feeder insert has an external cross section which is disposed so as to be perpendicular to the opening axis and which is preferably selected from the group composed of oval, out-of-round, rectangular and polygonal with rounded edges. On account of the external cross section, which preferably is not rotationally symmetrical, a feeder insert after having been inserted into the mold part, in particular into the recess in the mold part, may no longer be modified in terms of the alignment thereof, in particular in the circumferential direction in relation to the opening axis. The external cross section of the feeder insert is selected in such a manner that the feeder insert in the insertion direction of the recess may preferably only be inserted in a single orientation in relation to the corresponding shape of the recess.

In one preferred design embodiment of the invention the feeder insert has an external cross-sectional face which proceeding from the second end increases in the direction of the first end. Preferably, the external cross-sectional face gradually increases across a portion from the second end in the direction of the first end. The feeder insert therefore has the shape which is similar to that of a truncated cone. The cross-sectional face at the second end preferably corresponds to the cross-sectional face at the base of the recess, wherein the recess and the feeder insert in terms of the shape thereof communicate with one another in such a manner that the external side of the side wall of the feeder insert, in the case of the latter being pushed into the recess down to the base thereof, comes into contact with the internal side of the side wall of the recess only once said feeder insert reaches its terminal position in the recess, so that a force-fit between the wall faces is produced. By way of the force-fit which is preferably based on friction, the feeder insert is held so as to be jammed in the recess. In one design embodiment of the invention it is provided that the feeder insert is received along the entire length thereof in the recess between the first and the second end. One alternative design embodiment provides that the feeder insert is only received in portions, for example along two thirds of the entire length or else less thereof in the recess in the mold part.

Preferably, the feeder insert at the second end thereof, which is disposed so as to be opposite the wall portion having the passage opening, is configured so as to be open. By way thereof, a simplified design embodiment of the feeder insert is achieved, wherein the feeder insert may be configured so as to be integral, for example, this further simplifying the manufacture thereof. Integral here is preferably understood to mean that manufacturing is in one piece. Alternative design embodiments of the feeder insert provide that the latter is composed of one part which may however be joined together or assembled, respectively, from a plurality of pieces. On account of the feeder insert which at the second end thereof is open, the feeder cavity into which the liquid metal enters during the casting procedure is delimited by the base of the recess into which the feeder insert is inserted, that is to say by a wall face of the mold part. The base of the recess preferably runs parallel with the wall portion at the first end of the feeder insert.

According to one further design embodiment of the invention, the feeder cavity which is preferably delimited by the at least one side wall has an internal cross-sectional face which increases from the first end to the second end of the feeder insert. An integral feeder insert which is composed of a single piece may after manufacturing thereof be removed from the manufacturing mold in an advantageously simple manner. On account of the cross-sectional face which increases from the first end to the second end, a slight movement which preferably takes place in the direction parallel with the opening axis has the effect, that the internal side of the wall face may be released from the manufacturing mold and the manufactured feeder insert may be removed without damage from the manufacturing mold. In one design embodiment of the invention, the feeder cavity which is delimited by the internal side of the side wall has the shape which is similar to that of a conical and truncated pyramid.

Another design embodiment of the invention provides that the feeder insert is formed from exothermal molding material or at least in portions comprises exothermal molding material and/or is formed from insulating molding material or at least in portions comprises insulating molding material. By way of the employment of exothermal molding material, keeping the metal which is located in the feeder insert in the liquid phase is prolonged, since thermal energy which keeps the metal in the feeder insert at a temperature which is preferably above the solidus temperature is generated by the exothermal material of the feeder insert. Alternatively, the feeder insert may be configured from an insulating material which prevents thermal dissipation to the regions of the mold part which surround the feeder insert, so that the metal in the feeder cools at a slower rate than the metal in the mold cavity of the casting mold. In the case of a feeder insert which is assembled from a plurality of pieces, portions of the feeder insert may be configured from exothermal material, and portions may be configured from insulating material. In order to maintain the design embodiment of a sharp breaker edge toward the casting to be manufactured, that wall portion that has the passage opening is configured from an insulating material. The one or the plurality of side wall which is/are connected to the first wall portion may be composed of exothermal material.

It is preferable for the feeder insert on the internal side on the side wall thereof, preferably on a wall region which in the case of use of the feeder insert lies above the opening axis, to have one or a plurality of molded webs or wall portions which subdivide the feeder cavity in a chamber-like manner. With the aid of an internally protruding web or a wall portion, which is designed as a so-called Williams strip or a Williams wedge for example, premature formation of a casting skin on the surface of the liquid metal in the feeder cavity is counteracted. In this way, the effect of said feeder cavity, namely keeping the liquid metal located therein in a liquid form, is at the same time further improved.

Preferably, the web or the wall portion extends parallel with the opening axis of the passage opening along a portion of the side wall. The web preferably extends along the internal side of the feeder cavity from the first end to the second end of the feeder insert. The webs or wall portions, which are also known by the term of a Williams strip or a Williams wedge, may be a separately configured insertion part which is inserted into the feeder cavity of the feeder insert. Alternatively, the web or webs is/are molded on the internal contour of the feeder insert and is/are thus an integral part thereof. A molded web is preferably produced during the manufacture of the feeder insert and comprises, for example, a prismatic shape, wherein the web in the case of use of the feeder insert (that is to say during the casting operation) is disposed at the upper end of the feeder cavity. This advantageous design embodiment of the invention is in each case combinable with the independent aspects of the present invention. In terms of preferable combinations, the narrative made in the corresponding text passages applies in each case in a corresponding manner.

A further aspect of the invention relates to a method for manufacturing a casting mold having a vertical mold separation and a feeder insert which for dense feeding of the mold cavity during the casting procedure is attached to the casting mold, the method comprising the following steps: providing or manufacturing a first mold part, having a vertically running first separation face, for partially defining the mold cavity; providing or manufacturing a second mold part, having a second separation face running so as to be complementary to the first separation face, for partially defining the mold cavity, wherein the first separation face of the first mold part and the second separation face of the second mold part are provided for being joined together, configuring part of the mold cavity; providing or manufacturing a feeder insert for positioning in said first mold part, wherein the feeder insert has a volumetric center of gravity which is offset in relation to the opening axis of the passage opening of said feeder insert; positioning of the feeder insert in one of said mold parts, so that the opening axis of the feeder insert runs below the volumetric center of gravity of the latter; and subsequently producing the casting mold having the mold cavity, by joining together the first separation face of the first mold part and the second separation face of the second mold part. With the aid of the method steps according to the invention, a casting mold of at least two mold parts which are to be joined together may be manufactured in a simplified manner. A feeder insert which preferably is not (or only slightly) compressible (longitudinally compressible) and only after manufacturing of the mold part or the mold parts for a casting mold is positioned in at least one of the prefabricated mold parts may be used, wherein after positioning the opening axis of the feeder insert runs below the volumetric center of gravity of the latter. Therefore, manufacturing of the mold part in the mold chamber may be carried out without a feeder insert which has to be previously positioned therein. Potential damage to the feeder insert on account of the pressures prevailing during the compressing procedure may thus be excluded. On account thereof, any high compression pressures may be generated for compressing the molding material, and the strength of the prefabricated mold parts may be individually adapted. The casting mold is preferably manufactured by joining together two corresponding or complementary vertical separation faces of a first mold part and of a second mold part, respectively.

According to one preferred design embodiment of the method according to the invention, one of said mold parts has a recess, wherein the feeder insert for positioning in the prefabricated mold part of the casting mold is inserted into this recess. By providing a recess in a respective region of one of said mold parts, simple positioning of the feeder insert in the first or second mold part of the casting mold to be manufactured is achieved. The recess is preferably a cavity in the compressed molding material, into which the feeder insert is inserted and which does not participate in the design embodiment of the mold cavity for producing the casting. In order to avoid erroneous positioning of the feeder insert in the mold part, the recess and the feeder insert are preferably configured in such a manner that the latter define a preferred orientation for inserting the feeder insert into the recess. Alternatively, instead of a recess as a holding means for the feeder insert in the mold part, regions of the mold part may be equipped with protruding webs on which the feeder insert which is to be positioned in or inserted into the mold part, respectively, are held so as to be jammed.

Preferably, the casting mold having a vertical mold separation and a feeder insert which is attached to the casting mold is manufactured in a molding plant having an endless mold parts string. On account thereof, automated manufacturing of the casting molds is possible, on account of which manufacturing of the casting molds is accelerated and thus may be performed in shorter time. Castings which are made in high volumes may thus be economically manufactured with significantly reduced production complexity. The manufacture of the casting mold in the molding plant preferably comprises at least joining together of the first separation face of the first mold part and the second separation face of the second mold part, wherein a string of casting molds which are preferably lined up behind one another is produced. The produced string is then continuously or cyclically moved onward in the processing direction. The first and second mold parts which have been joined together in the molding plant may be manufactured in separate molding plants for example, and after their respective manufacture may be provided to said molding plant in order for the casting mold to be manufactured. Inserting the feeder insert into at least one of said first and second mold parts may already be carried out in the separate molding plants for manufacturing the mold parts or in said molding plant for joining the mold parts which are provided to the molding plant.

Alternatively, it is provided in one design embodiment of the method according to the invention that the feeder insert is positioned in the first and/or in the second mold part of the casting mold, wherein said mold parts are prefabricated in a or the molding plant, respectively, having an endless mold parts string. Thus, apart from joining together the prefabricated mold parts, manufacturing of the individual mold parts is also performed in said molding plant. In this way, manufacturing of the mold parts and of the casting mold which is to be joined therefrom is advantageously implemented using a single molding plant, on account of which providing the mold parts is dispensed with and the logistic complexity is minimized. This advantageous design embodiment of the invention is in each case combinable with the independent aspects of the present invention. In terms of preferable combinations, the narrative made in the corresponding text passages applies in each case in a corresponding manner.

Preferably, the first and/or the second mold part(s) is/are prefabricated in a mold chamber of said molding plant, in that molding material is injected into the mold chamber and preferably compressed. With the aid of the mold chamber a molding space for producing the mold part of which the wall regions image predetermined areas of the mold part to be manufactured is predefined. Preferably, natural sands, semi-synthetic molding sands, or synthetic molding materials which are introduced into the mold chamber, in particular are injected under high pressure into the mold chamber, are used as molding material. By way of injecting the molding material, compression of the molding material is performed at the same time, the latter optionally being potentially sufficient in order to guarantee sufficient cohesion of the injected molding material without further post-processing. Preferably, the molding material which has been injected into the mold chamber is additionally compressed by a compression force acting on the molding material. Moreover, this has the effect of increased bonding forces between the material particles of the molding material and increased strength of the manufactured mold part.

Another refinement of the method according to the invention provides that the first and the second mold part are manufactured in a mold chamber of a molding plant having a pivoting plate and a pressing plate, wherein injected molding material is compressed by way of a relative movement between the pivoting plate and the pressing plate. Generating a relative movement between the pivoting plate and the molding plate has the effect of an advantageously simple possibility for applying a pressure force on the molding material which has been injected into the mold chamber. In order for the relative movement between the pivoting plate and the pressing plate to be implemented, at least one of the pattern halves which preferably laterally delimit the mold chamber and which are aligned so as to be substantially parallel with one another is moved in the direction of the respective other pattern half or plate. One alternative embodiment provides that both the pivoting plate as well as the pressing plate having the pattern halves disposed thereon are converged and carry out a linear movement in a preferably horizontal plane. The spacing between the pressing plate, which is mounted on the press piston, and the pivoting plate in relation to the initial spacing immediately prior to compressing, during the compression procedure is reduced by preferably at least 20%, particularly preferably by at least 40%. The compression rate of the molding material used for configuring the mold parts in particular depends on the composition of said molding material and may be tuned to the respective application.

In one refinement of the method according to the invention, the first and/or the second mold part(s) is/are manufactured in a mold chamber of said molding plant, which is partially delimited by a positive pattern of at least one portion of the feeder insert. With the aid of the positive pattern of at least one portion of the feeder insert, the recess which is used for inserting the feeder insert may be preferably produced in a simple manner in one of the mold parts.

Moreover, by way of configuring a recess by way of the positive pattern in the mold chamber, simple positioning in a preferably predefined insertion alignment of the feeder insert in relation to the mold part is producible. This advantageous design embodiment of the invention is in each case combinable with the independent aspects of the present invention. In terms of preferable combinations, the narrative made in the corresponding text passages applies in each case in a corresponding manner.

Preferably, the mold chamber is formed between a pivoting plate and a pressing plate, wherein the positive pattern is disposed on the pivoting plate or on the pressing plate. On account thereof, the recess for the feeder insert is produced in particular on or in the vertical separation face of the mold part to be manufactured. Depending on which region of the mold cavity of the casting mold the recess has to be configured in, the positive pattern is correspondingly configured or disposed on the pivoting plate or on the pressing plate. The positive pattern images at least one portion of the feeder insert, in the direction of extent proceeding from the second end in the direction of the first end, which is to be positioned in the mold part. In one alternative design embodiment, the positive pattern which is configured on the pivoting plate or pressing plate has the shape of the entire feeder insert, wherein the cross-sectional face of the positive pattern, proceeding from the free end of the latter, increases in the direction of the pressing or pivoting plate.

Preferably, contour regions of mold cavities of two adjacent casting molds are configured on faces of the first mold part which face away from one another during compression of the first mold part of the casting mold. In the method according to the invention a mold part which does not only have a contour of a region of a mold cavity on one of the lateral faces but preferably has contour regions of mold cavities of two casting molds which are to be separately manufactured on both lateral faces which face away from one another is produced. Depending on the design embodiment of the casting to be manufactured, the contour regions on the faces of the mold part which face away from one another may be configured so as to be identical, similar, or dissimilar. This advantageous design embodiment of the invention is in each case combinable with the independent aspects of the present invention. In terms of preferable combinations, the narrative made in the corresponding text passages applies in each case in a corresponding manner.

In one refinement of the method according to the invention, the feeder insert is positioned manually or in an automated manner by means of an insertion installation in the first and/or second mold part. Positioning of the feeder insert in the mold part is preferably performed by means of an insertion installation which in comparison with manual insertion has the advantage that the insertion procedure is performed in a standardized manner. Erroneous placing or a flawed casting resulting therefrom, respectively, may be advantageously avoided by way of mechanized insertion using an insertion installation with automated operation. Moreover, fixed cycle times may be implemented by way of the insertion installation, which has an advantageous effect on the steps which have to be subsequently carried out for manufacturing the casting molds to be produced.

Preferably, the feeder insert during positioning in the first and/or the second mold part is held on a holding part of the insertion installation by means of negative pressure or of a form-fit. Holding the feeder insert on the insertion installation by means of negative pressure has the advantage that the connection to the holding part of the insertion installation may be released in a simple manner by cancelling the negative pressure, once the feeder insert has been inserted into the mold part. Moreover, it is avoided that the feeder insert is inadvertently moved out of the recess in the mold part again. Alternatively, a form-fit between the holding part and an opening which is configured on the feeder insert, for example, is caused, by way of which form-fit the feeder insert may be inserted in the predetermined alignment of the latter preferably into the recess in the mold part. Form-fit is presently understood to mean receiving the feeder insert by way of guide pins on the holding part, for example, by means of which the feeder insert by way of the openings thereof is held counter to gravity preferably in the wall portion at the first end.

The invention furthermore relates to a casting mold having a vertical mold separation, comprising a) a first mold part, and b) a feeder insert which for dense feeding of the mold cavity during the casting procedure is positioned in the first mold part, manufacturable according to a method according to one of the afore-described preferred embodiments, wherein the feeder insert is positioned in the first mold part of the casting mold such that the opening axis of said feeder insert runs below the volumetric center of gravity of the latter. Such a casting mold according to the invention may be manufactured in a simplified manner, since the feeder insert of which the passage opening for the transfer of liquid metal during the casting procedure is disposed below the volumetric center of gravity of the feeder is only inserted into a respective mold part after prefabrication of a first or second mold part of the casting mold. Manufacturing the mold part of the casting mold is thus performed without a feeder insert in the mold chamber of a molding plant as described above. Damage to the feeder insert or erroneous alignment in relation to the mold cavity which is configured so as to be adjacent is thus avoided. Preferably, the casting mold or at least one of the mold parts configuring the casting mold, respectively, has a recess into which the feeder insert is inserted in a preferably force-fitting and/or form-fitting manner. The recess is preferably located in a vertically running wall portion of the mold part, which configures a contour region of the mold cavity of the casting mold.

One refinement of the casting mold according to the invention provides that one or a plurality of ventilation ducts which communicate with ventilation openings of the feeder insert are disposed in the first mold part and/or a complementary second mold part. By way of the ventilation ducts which during the use of the casting mold preferably run in the vertical direction, formation of a gaseous volume above the liquid metal in the feeder insert may be counteracted in particular during the casting procedure. It is ensured in this way that the feeder insert at all times is completely filled with liquid metal. Accordingly, the size of the feeder may be individually adapted to the shrinkage behavior of the casting to be manufactured, and a feeder insert having a comparatively small feeding volume, which almost corresponds to the shrinkage behavior of the casting, may be used. The ventilation duct or ventilation ducts is/are preferably produced by way of a positive pattern which is disposed on the mold plate for the first and/or second mold part.

Preferably, a preferably planar wall portion of the mold cavity is configured by the external wall of the feeder insert, on account of which a simple design embodiment of the feeder insert, in particular at the first end thereof, is achieved. Preferably, a vertically running wall portion of a contour region of the mold cavity of the casting mold is produced. In terms of further preferred design embodiments of the casting mold according to the invention, reference is made to the above explanations relating to the use according to the invention or the method according to the invention for manufacturing a casting mold, respectively.

The invention also relates to a feeder insert having a volumetric center of gravity which is offset in relation to the opening axis of the passage opening of said feeder insert, for use according to one of the afore-described preferred embodiments, wherein the feeder insert has a first end having a passage opening, a second end, and one or a plurality of side walls which extend(s) from the first to the second end and which delimit(s) a feeder cavity for receiving liquid metal, and has a wall portion which is disposed at the first end and which forms a lateral wall region of the mold cavity of the casting mold, wherein additionally one or a plurality of openings for ventilating the feeder cavity and/or for holding means of an insertion installation engaging therein are disposed in the wall portion which has the passage opening, and wherein the feeder insert in relation to the longitudinal extent thereof in the direction of the opening axis is non-destructively longitudinally compressible by not more than 5%, preferably not more than 2%.

The invention is based on the concept that a mold part of a casting mold having a vertical mold separation after prefabrication in preferably a mold chamber of a molding plant may be equipped in a simple manner with such a feeder insert configured according to the invention. However, the employment of a longitudinally compressible feeder of complex design, or of a telescopic feeder, respectively, can be dispensed with. The feeder according to the invention here is inserted into the mold part of the casting mold in such a manner that the opening axis of the passage opening of said feeder runs below the volumetric center of gravity of the feeder insert, on account of which follow-on feeding of isolated and heavy casting portions in the mold cavity of the casting mold, for example, is possible from the side. Preferably, the feeder insert in the direction of the opening axis of the passage opening thereof is non-destructively longitudinally compressible by less than 5%, preferably less than 2%. Accordingly, the feeder insert has a limited deformation capability. The feeder insert is thus not adapted for being longitudinally compressed in relation to the longitudinal extent thereof between the first end having the passage opening thereof and the second end, so as to compensate for a compression procedure. The feeder insert in one design embodiment is integrally configured; moreover, the feeder insert at the first end thereof has a wall portion having a passage opening disposed therein for the liquid metal. Proceeding from the wall portion at the first end, one or a plurality of side wall(s) which preferably perpendicularly protrude(s) from the wall portion at the first end extend in the direction of the second end of the feeder insert.

According to one preferred embodiment of the feeder insert according to the invention, the feeder insert has an external cross-sectional face which proceeding from the second end increases in the direction of the first end. The feeder insert which is inserted into a recess which is configured in the mold part, by way of the tapered cross section in the direction of the second end thereof may be positioned in a recess in the mold part in a simplified manner. Preferably, a force-fit or form-fit, respectively, between the external wall of the feeder insert and the internal wall of the recess in the mold part during insertion of the feeder insert into the recess is produced only shortly before the terminal position in the recess has been reached. On account thereof, precise positioning of the feeder insert is possible with comparatively low effort, since any potential friction forces between the mutually contacting wall regions have to be overcome only in the last portion of the positioning movement in the insertion direction. Proceeding from the second end of the feeder insert, the cross-sectional face of the feeder insert widens preferably in a uniform manner across a portion of the feeder insert in the direction of extent. The widening portion corresponds to at least half of the entire length of the feeder insert in the direction of extent, preferably to two thirds of the entire length of the feeder insert in the direction of extent.

In one further design embodiment of the feeder insert, the latter at the second end thereof, which is disposed so as to be opposite to the wall portion having the passage opening, is preferably configured so as to be open. On account of the design embodiment of said feeder insert which is open at the second end thereof, the feeder insert according to the invention per se may be manufactured in an advantageously simple manner in a molding space from which the feeder insert according to the invention may be removed by way of the second open end thereof. This advantageous design embodiment of the invention is in each case combinable with the independent aspects of the present invention. In terms of preferable combinations, the narrative made in the corresponding text passages applies in each case in a corresponding manner.

BRIEF DESCRIPTION OF THE SEVERAL VIEWS OF THE DRAWINGS

The invention will be explained in more detail hereunder by means of a potential exemplary embodiment with reference to the appended figures in which.

DETAILED DESCRIPTION OF THE INVENTION

Figure 1:
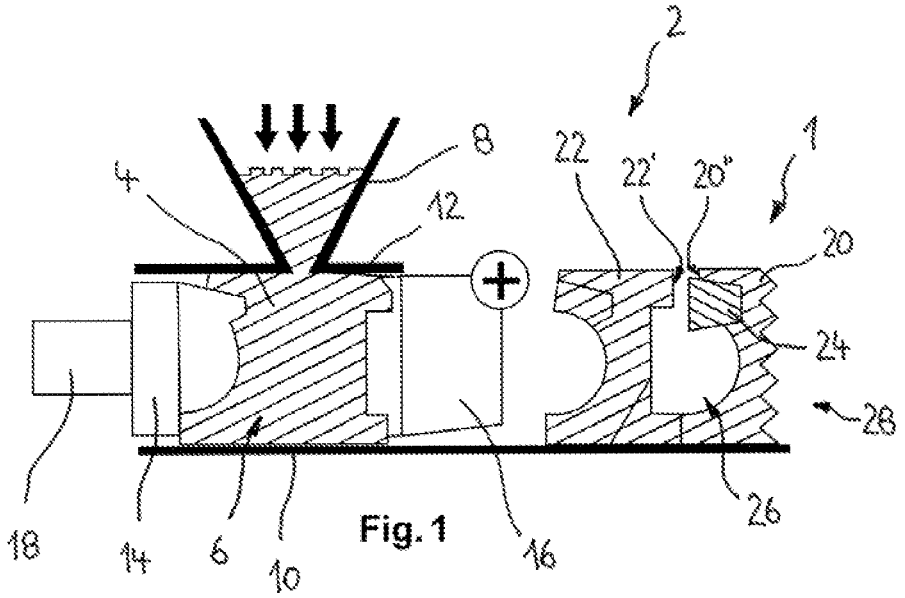
FIG. 1 shows a schematic illustration of two mold parts which have previously been manufactured in the mold chamber and have already been joined together by joining the separation faces.

A continuous method for manufacturing casting molds 1 in a schematically illustrated molding plant 2 is shown in FIGS. 1 to 8. In the present case, for the following description one cycle of the method, proceeding from the method step of filling molding material 4 into a mold chamber 6 of the molding plant 2, is assumed as being the first step of a continuously progressing method. The molding material 4 which is preferably injected into the mold chamber 6 is provided above the mold chamber 6 in a supply installation 8. The mold chamber 6 is formed by stationary upper and lower wall regions 10, 12, to the left by a pressing plate 14, and to the right by a pivoting plate 16. The pressing plate 14 is connected to a press piston 18 which is held in a linearly displaceable manner. To the right in FIG. 1, two mold parts 20, 22 which have previously been manufactured in the mold chamber 6 and have already been joined together by joining the separation faces 20", 22' thereof which face one another to form a casting mold 1 are depicted. The mold part 20 of the casting mold 1 is already equipped with a feeder insert by which follow-on feeding of liquid metal is guaranteed from the side through the mold cavity 26 of the casting mold 1, which is formed by the mold parts 20, 22. The lined-up mold parts configure an endless mold parts string 28.

Figure 2:
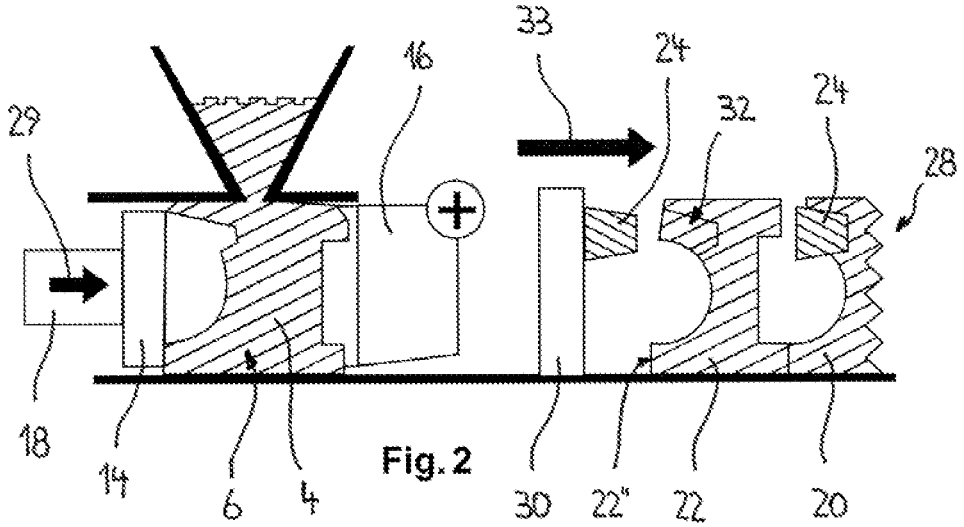
FIG. 2. shows a schematic illustration in which the molding material which is located in the now completely closed mold chamber is compressed.

FIG. 2 shows in a next step of the method according to the invention, in which the molding material 4 which is located in the now completely closed mold chamber 6 is compressed. In order to be compressed, the pressing plate 14 by way of the press piston 18 is moved in the direction of the pivoting plate 16 (arrow 29), on account of which the spacing between the pressing plate 14 and the pivoting plate 16 is reduced. The mold parts string 28 of lined-up mold parts 20, 22 with the aid of a conveying installation (not illustrated in more detail) is moved or transported further to the right, so as to create free space for the mold part which is just about to be produced in the mold chamber 6. At the same time, an insertion installation 30 is driven in a perpendicular manner to the viewing plane between the mold chamber 6 and the mold parts string 28 of the mold parts 20, 22, by means of which insertion installation 30 a feeder insert 24 which is to be positioned in a recess 32 in the mold part 22 is received. In order for the feeder insert 24 to be positioned in the recess 32, the insertion installation 30 is displaced in the direction of the separation face 22" of the mold part 22 (arrow 33).

Figure 3:
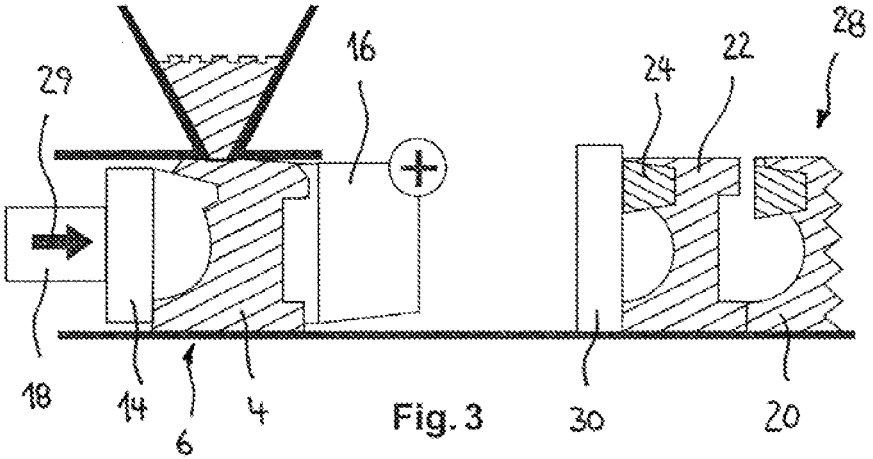
FIG. 3. shows a schematic illustration of the molding material in the mold chamber further compressed between the displaceable press piston having the pressing plate and the pressing plate.

FIG. 3 shows a subsequent step of the method according to the invention, wherein the molding material 4 in the mold chamber 6 is further compressed between the displaceable press piston 18 having the pressing plate (arrow 29) and the pressing plate 16. At the same time, the feeder insert 24 is positioned by the insertion installation 30 in the recess 32 of the mold part 22, wherein the feeder insert 24 is inserted into the prefabricated mold part 22 such that the opening axis (not shown in more detail) of the passage opening of said feeder insert for the liquid metal runs below the volumetric center of gravity of said feeder insert. The feeder insert is received on the insertion installation by way of a holding part (not illustrated in more detail), wherein the feeder insert 24 by means of negative pressure which is generated by the insertion installation 30 and acts on the feeder insert is held on or fixed to the insertion installation 30, respectively.

Figure 4:
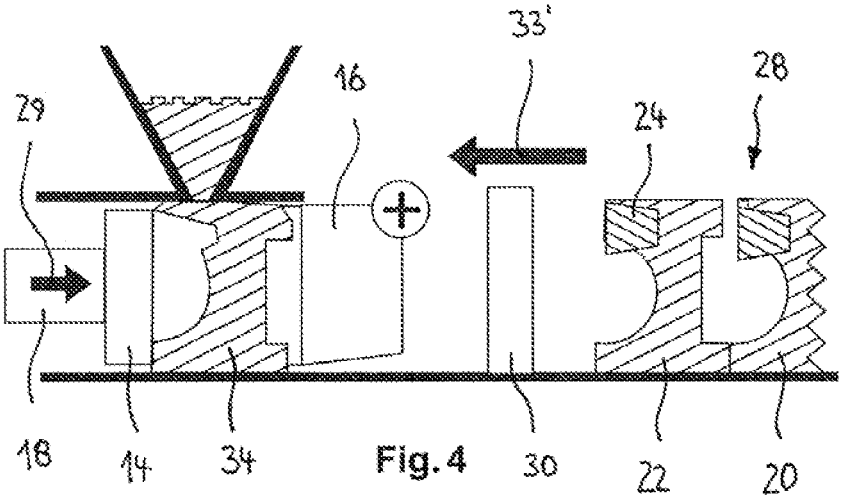
FIG. 4 shows a schematic illustration of the casting mold having the vertical mold separation at that point in time at which the feeder insert has been positioned in the recess of the mold part by the insertion installation.

FIG. 4 shows the step of the method according to the invention for manufacturing the casting mold having the vertical mold separation at that point in time at which the feeder insert 24 has been positioned in the recess of the mold part 22 by the insertion installation 30 and is subsequently moved back in the direction (arrow 33') of the mold chamber 6. Subsequently (not shown in more detail), the insertion installation 30 is retracted perpendicularly to the viewing plane from between the mold chamber 6 and the mold parts string 28. Moreover, it is shown in FIG. 4 how the press piston 18 having the pressing plate 14 thereof (arrow 29) at the end of the compression procedure of the molding material 4 in the mold chamber 6 is displaced to the terminal position of the former, on account of which manufacturing of the mold part 34 having a recess 32 for a feeder insert is terminated. The mold part 34 now has a design embodiment which is identical to that of the previously manufactured mold parts 20 and 22.

Figure 5:
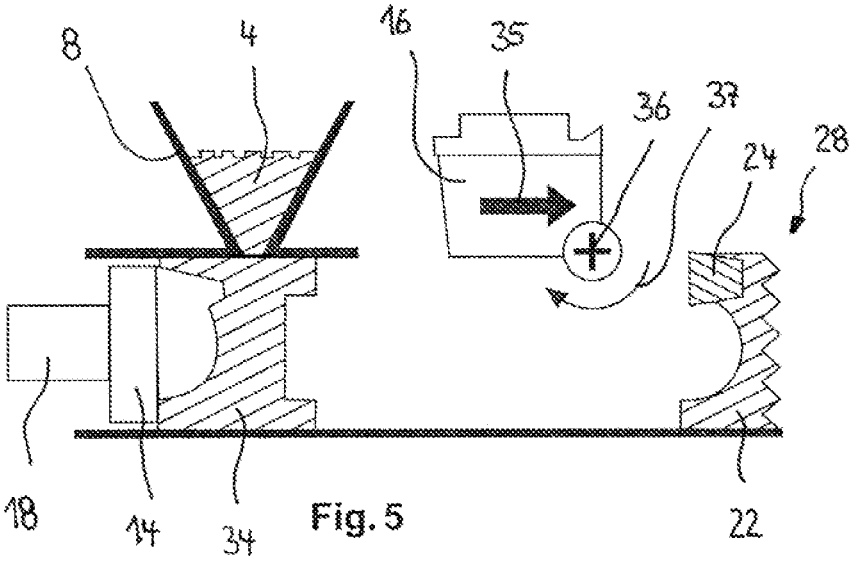
FIG. 5 shows a schematic illustration of the ejection of the prefabricated mold part from the mold chamber.

FIG. 5 shows the ejection of the prefabricated mold part 24 from the mold chamber 6, wherein the pivoting plate 16 is moved in the direction (arrow 35) of the mold parts string 28 of mold parts 20, 22 and by way of a pivoting movement (arrow 37) is upwardly pivoted about the pivot axis 36. After the pivoting plate 16 has been displaced to the stand-by position thereof, the former has a substantially horizontal alignment.

Figure 6:
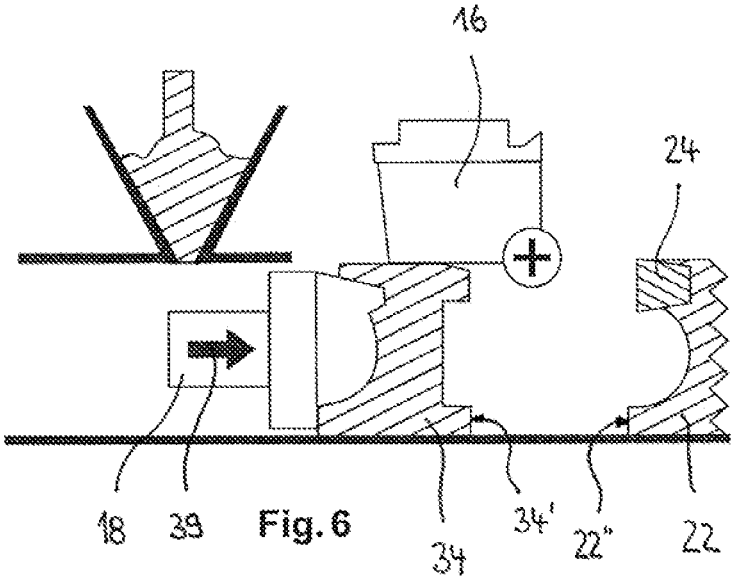
FIG. 6 shows a schematic illustration of the prefabricated mold part ejected from the mold chamber by means of the press piston.
Figure 7:
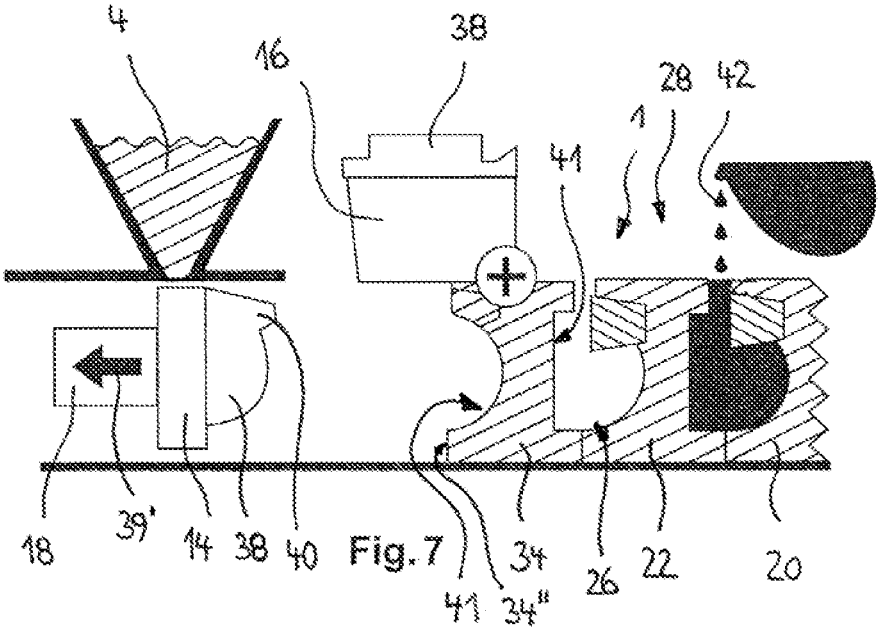
FIG. 7 shows a schematic illustration of the prefabricated mold part bears on the separation face of the mold part.
Figure 8:
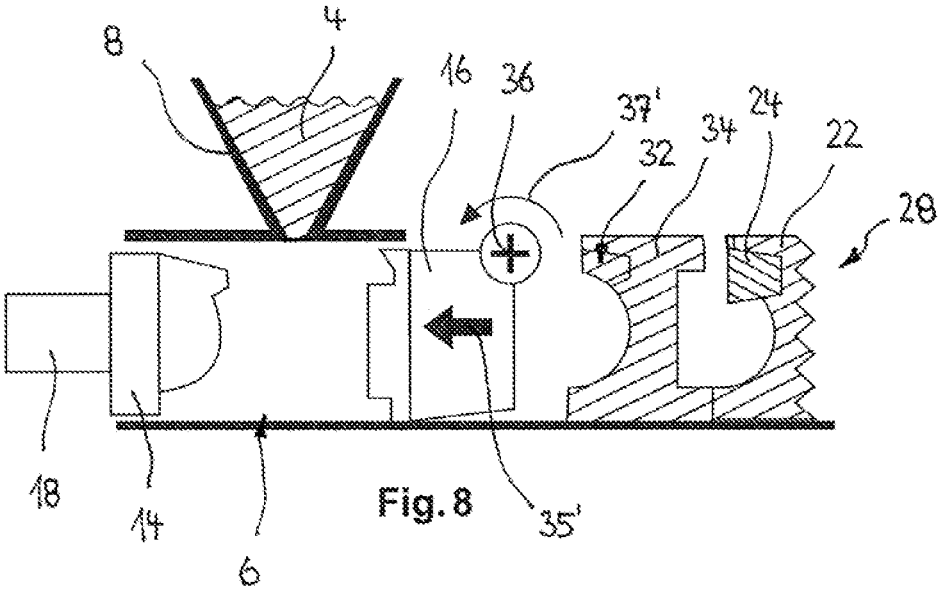
FIG. 8 shows a schematic illustration of the empty mold chamber where there system is ready to start producing a new part.

In FIG. 6 it is shown how the prefabricated mold part is ejected (arrow 39) from the mold chamber 6 by means of the press piston 18, until the mold part 34 by way of the separation face 34' thereof bears on the separation face 22" of the mold part 22, as can be seen in FIG. 7. A predetermined amount of molding material 4 for the subsequent cycle is filled into the supply installation 8 of the molding plant 6.

Once the mold part 34 has been brought to bear on the previously manufactured mold part 22, the press piston moves back into the initial position thereof (arrow 39') prior to the commencement of the compression procedure shown in FIG. 1. It can be seen here that the pressing plate 14, apart from the positive pattern 38 for the contour region 41 on the separation face 34" of the mold part 34, also comprises the positive pattern 40 of at least one portion of the feeder insert 24 to be inserted into the mold part 34 for producing the recess 32 in the mold part 34. As can be seen from the present figures, the contour regions 41, 41' of two adjacent mold cavities 26 of casting molds 1 to be produced are configured on the separation faces 34, 34" of the mold part 34 which face away from one another. The positive pattern 38' which produces the contour region 41' is disposed on the pivoting plate 16. As can be furthermore seen in FIG. 7, apart from manufacturing the casting molds 1 by way of the molding plant 2 and from producing an endless mold parts string of mold parts 20, 22, 34 casting of castings is performed by filling liquid metal 42 into the casting molds 1 which are lined up behind one another.

In order for a cycle of the method according to the invention to be completed, the pivoting plate 16 from the stand-by position thereof, having the horizontal alignment, is pivoted back about the pivot axis 36 into the vertical position thereof (arrow 37') and, for configuring the mold chamber 6, is likewise displaced in the direction (arrow 35') of the pressing plate 14, back to the operating position thereof for the pending compression process. In this way, one cycle of the method according to the invention is completed, and the next cycle for manufacturing a mold part starts, commencing with the method step shown in FIG. 1, wherein molding material 4 is injected from the supply installation 8 into the mold chamber 6.

Figure 9:
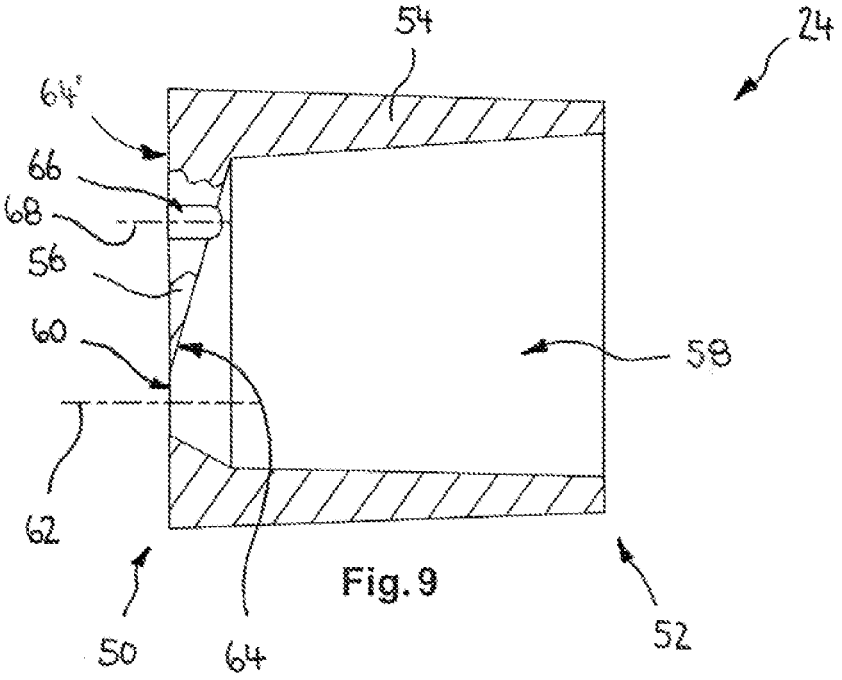
FIG. 9 shows a sectional illustration of a first exemplary embodiment of a feeder insert according to the invention.

A sectional illustration of a feeder insert 24 according to the invention, which is only schematically depicted in FIGS. 1 to 8, is shown in FIG. 9, said feeder insert 24 having a first end 50, a second end 52, and one or a plurality of side walls 54 which extend between the first and the second end 50, 52. A wall portion 56 which is disposed at the first end 50 and the side wall 54 which protrudes substantially perpendicularly from the wall portion 56 partially delimit the feeder cavity 58 for receiving liquid metal. The wall portion 56 has a passage opening 60 by way of which the connection between the mold cavity 26 of a casting mold 1 (FIG. 1) and the feeder cavity 58 is established. The passage opening 60 has an opening axis 62 which is aligned so as to be offset in relation to the volumetric center of gravity of the feeder insert 24. The wall portion 56 has an internal wall face 64 which delimits a cavity portion of the feeder cavity which tapers in the direction of the passage opening 60. The wall face 64 is conically configured. The wall face 64' of the wall portion 56 which faces the mold cavity in the shown embodiment is configured so as to be planar. Moreover, an opening 66 for ventilating the feeder cavity 58 is disposed on the wall portion 56, the opening axis 68 of said opening 66 running parallel to the opening axis 62 of the passage opening 60. The feeder insert 24 according to the invention has an external cross-sectional face which proceeding from the second end 52 increases in the direction of the first end 50. However, the cross section of the feeder cavity 58 which is delimited by the side wall 54 proceeding from the second end 52 decreases in the direction of the first end 50 of the feeder insert 24; as can be seen in FIG. 9, the feeder insert 24 is integrally configured, wherein the feeder insert is formed from an exothermal and/or insulating molding material, or in portions comprises exothermal and/or insulating molding material. In the shown embodiment, the feeder insert 24 at the second end 52 is configured so as to be open and is configured without a web which extends parallel with the opening axis 62 of the passage opening 60 along a portion of the side wall 54.

Figure 10:
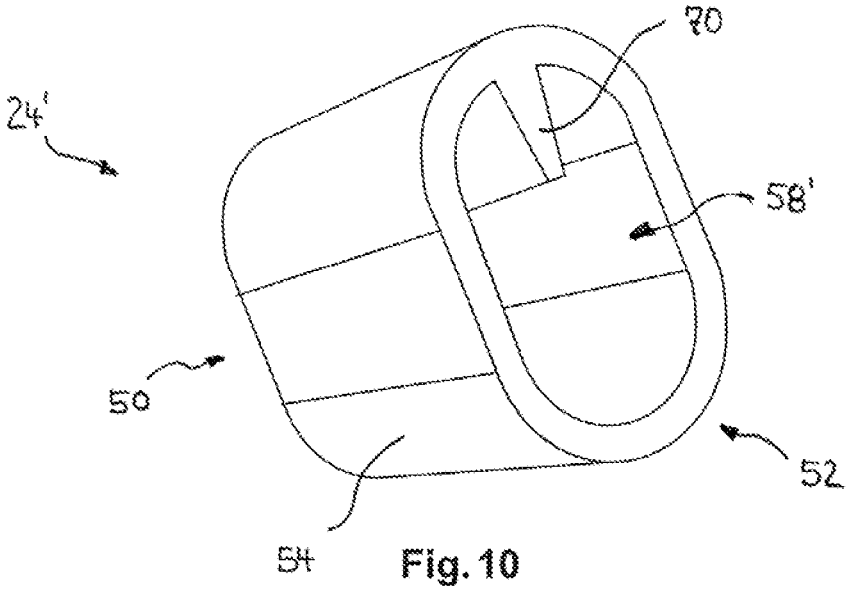
FIG. 10 shows a perspective illustration of a second exemplary embodiment, toward the second open end thereof.

FIG. 10 shows a second exemplary embodiment of a feeder insert 24' according to the invention, which is configured in an almost identical manner to that of the exemplary embodiment shown in FIG. 9. As is the feeder insert 24, the feeder insert 24' at the second end 52 is configured so as to be open. The feeder insert 24' differs from the feeder insert 24 (FIG. 9) in that the former has a web or a wall portion 70 which subdivides the feeder cavity 58' in a chamber-like manner. For use of the feeder insert 24, the web 70 which is also known by the term Williams strip or Williams wedge, is disposed above the opening axis 62 (FIG. 9).

Preferred aspects of the present invention are stated hereunder, using the reference signs which have been introduced above. The reference signs here are not to be understood as limiting but rather merely as means for facilitating understanding by reading, since the stated aspects do not relate exclusively to the figures discussed above. The aspects stated hereunder comprise features which may be combined with other preferred features which may be derived from the description and/or the claims.

LIST OF REFERENCE SIGNS

1 Casting mold
2 Molding plant
4 Molding material
6 Mold chamber
8 Supply installation
10, 12 Wall region
14 Pressing plate
16 Pivoting plate
18 Press piston
20, 22 Mold part
20', 20" Separation face
22', 22" Separation face
24, 24' Feeder insert
26 Mold cavity
28 Mold parts string
29 Compression press piston
30 Insertion installation
32 Recess
33, 33' Movement insertion installation
34 Mold part
34', 34" Separation face
35, 35' Movement pivoting plate
36 Pivot axis
37, 37' Pivoting movement pivoting plate
38 Positive pattern casting
39 Ejecting mold part
39' Returning movement press piston
40 Positive pattern feeder insert
41, 41' Contour region
42 Metal
50 First end
52 Second end
54 Side wall
56 Conversion portion
58 Feeder cavity
60 Passage opening
62 Opening axis
64, 64' Wall face
66 Ventilation opening
68 Opening axis
70 Web

The invention claimed is:

1. A method of manufacturing a casting mold, comprising:

feeding a feeder insert (24, 24'), having a volumetric center of gravity which is offset in relation to the opening axis (62) of the passage opening (60) of said feeder insert (24, 24'), in the manufacture of a casting mold (1) having a vertical mold separation, wherein the feeder insert (24, 24') is attached to the casting mold (1) and feeds a mold cavity (26) during the casting procedure, wherein the feeder insert (24, 24') is positioned in a prefabricated mold part (20, 22, 34) of the casting mold (1) such that the opening axis (62) of said feeder insert (24, 24') runs below the volumetric center of gravity of the feeder insert.

2. The method according to claim 1, wherein the feeder insert (24, 24') for positioning in the prefabricated mold part (20, 22, 34) of the casting mold (1) is inserted into a recess (32) in the prefabricated mold part (20, 22, 34) of the casting mold (1).

3. The method according to claim 1, wherein the casting mold (1) having a vertical mold separation and a feeder insert (24, 24') which for feeding of the mold cavity (26) during the casting procedure is attached to the casting mold (1) is manufactured in a molding plant (2) having an endless mold parts string (28).

4. The method according to claim 1, wherein the mold part (20, 22, 34) is prefabricated in a mold chamber (6) which is partially delimited by a positive pattern (40) of at least one portion of the feeder insert (24, 24').

5. The method according to claim 1, wherein the feeder insert (24, 24') is inserted manually or in an automated manner by means of an insertion installation (30) into the recess (32).

6. The method according to claim 1, wherein the feeder insert (24, 24')

has a first end (50) having a passage opening (60), a second end (52), and one or a plurality of side walls (54) which extend from the first to the second end (50, 52) and which delimit a feeder cavity (58) for receiving liquid metal, and has a wall portion (56) which is disposed at the first end (50) and which forms a lateral wall region of the mold cavity (26) of the casting mold (1).

7. The method according to claim 6, wherein additionally one or a plurality of openings (66) for ventilating the feeder cavity (58) and/or for holding means of an insertion installation (30) engaging therein is/are disposed in the wall portion (56) which has the passage opening (60).

8. The method according to claim 6, wherein the feeder insert (24, 24') in relation to the longitudinal extent thereof in the direction of the opening axis (62) is non-destructively longitudinally compressible by not more than 5%.

9. The method according to claim 6, wherein the feeder insert (24, 24') has a cross section having an external cross-sectional face which proceeding from the second end increases in the direction of the first end.

10. The method according to claim 6, wherein the feeder insert (24, 24') at the second end (52) thereof, which is disposed so as to be opposite the wall portion (56) having the passage opening (60), is configured so as to be open.

11. A method for manufacturing a casting mold (1) having a vertical mold separation and a feeder insert (24, 24') which for feeding of the mold cavity (58) during the casting procedure is attached to the casting mold (1), the method comprising the following steps:

providing or manufacturing a first mold part (20, 22), having a vertically running first separation face (20', 22'), for partially defining the mold cavity (26), providing or manufacturing a second mold part (22, 34), having a second separation face (22", 34") running so as to be complementary to the first separation face (20', 22'), for partially defining the mold cavity (26), wherein the first separation face (20', 22') of the first mold part (20, 22) and the second separation face (22", 34") of the second mold part (22, 34) are provided for being joined together, configuring part of the mold cavity (26), providing or manufacturing a feeder insert (24, 24') for positioning in one of said mold parts (20, 22, 34), wherein the feeder insert (24, 24') has a volumetric center of gravity which is offset in relation to the opening axis of the passage opening of said feeder insert (24, 24'), positioning of the feeder insert (24, 24') in one of said mold parts (20, 22, 34), so that the opening axis (62) of the feeder insert (24, 24') runs below the volumetric center of gravity of the feeder insert, and subsequently producing the casting mold (1) having the mold cavity (58), by joining together the first separation face (20', 22') of the first mold part (20, 22) and the second separation face (22", 34") of the second mold part (22, 34), wherein one of said mold parts (20, 22, 34) has a recess (32), and the feeder insert (24, 24') for positioning in the mold part (20, 22, 34) of the casting mold (1) is inserted into this recess (32).

12. The method according to claim 11, wherein the casting mold (1) having a vertical mold separation and a feeder insert (24, 24') which is attached to the casting mold (1) is manufactured in a molding plant (2) having an endless mold parts string (28).

13. The method according to claim 11, wherein the first and/or the second mold part(s) (20, 22, 34) is/are manufactured in a mold chamber (6) of said molding plant (2), which is partially delimited by a positive pattern (40) of at least one portion of the feeder insert (24, 24').

14. The method according to claim 11, wherein the feeder insert (24, 24') is positioned manually or in an automated manner by means of an insertion installation (30) in the first and/or second mold part (20, 22, 34).

15. A feeder insert (24, 24') having a volumetric center of gravity which is offset in relation to the opening axis of the passage opening of said feeder insert (24, 24'), for use according to claim 1, wherein the feeder insert (24, 24') has a first end (50) having a passage opening (60), a second end (52), and one or a plurality of side walls (54) which extend(s) from the first to the second end and which delimit(s) a feeder cavity (58) for receiving liquid metal, and has a wall portion (56) which is disposed at the first end (50) and which forms a lateral wall region of the mold cavity (26) of the casting mold (1), wherein additionally one or a plurality of openings (66) for ventilating the feeder cavity (58) and/or for an insertion installation (30) engaging therein are disposed in the wall portion (56) which has the passage opening (60), wherein the feeder insert (24, 24') in relation to the longitudinal extent thereof in the direction of the opening axis (62) is non-destructively longitudinally compressible by not more than 5%, and wherein the feeder insert (24, 24') at the second end (52) thereof, which is disposed so as to be opposite the wall portion (56) having the passage opening (60), is configured to be open.

* * * * *